US006092895A

United States Patent [19]

Sato et al.

[11] Patent Number: 6,092,895

[45] Date of Patent: Jul. 25, 2000

[54] LENS FRAME ASSEMBLY FOR A DIVING MASK

[75] Inventors: Hiromasa Sato; Taro Fujima, both of Tokyo, Japan

[73] Assignee: Tabata Co., Ltd., Tokyo, Japan

[21] Appl. No.: 09/292,518

[22] Filed: Apr. 15, 1999

[30] Foreign Application Priority Data

Apr. 17, 1998 [JP] Japan ..... 10-107912

[51] Int. Cl.[7] ..... G02C 1/00

[52] U.S. Cl. ..... 351/43; 2/429

[58] Field of Search ..... 351/43, 149, 158; 2/426, 428, 443, 429

[56] References Cited

U.S. PATENT DOCUMENTS 5,603,124 2/1997 Garofalo ..... 2/428

5,638,552 6/1997 Fujima ..... 2/428

FOREIGN PATENT DOCUMENTS 2665166 6/1997 Japan .

*Primary Examiner*—Huy Mai

*Attorney, Agent, or Firm*—Baker & Daniels

[57] ABSTRACT

A diving face mask including a lens, a main frame and a lens holding frame. The main frame and the holding frame are integrally interlocked together by first projections and second recesses arranged between an outer peripheral surface of the main frame and an outer edge of the holding frame covering this outer peripheral surface.

8 Claims, 4 Drawing Sheets

LENS FRAME ASSEMBLY FOR A DIVING MASK

BACKGROUND OF THE INVENTION

The present invention relates to a diving face mask used for during skin or scuba diving.

Japanese Patent Registration No. 2665166 discloses a diving face mask comprising a pair of front lenses, a lens frame, a cylindrical skirt and a strap used to hold the mask on a wearer's head. The lens frame comprises, in turn, an outer frame detachably receiving the front lens from the front and an inner frame adapted to snap-locked with an inner side of the outer frame.

The above-mentioned diving face mask is characterized in that the inner frame is elastically deformed so as to reduce its diameter sufficiently to tightly engage the inner side of the outer frame. Such elastical deformability of the inner frame should be maintained even when it is desired to make the inner frame sufficiently robust to prevent the lens from falling off and/or the inner frame from being damaged. Consequently, it is often difficult to assure a desired robustness of the inner frame.

In view of the problem as has been described above, it is an object of the present invention to provide a diving face mask allowing an adequately robust frame to be employed.

According to one embodiment of the invention, there is provided a diving face mask which comprises:

a front lens;

a lens frame in which said front lens is mounted;

a cylindrical skirt extending rearward from said lens frame;

said lens frame including an annular main frame and an annular holding frame adapted to be detachably locked on said main frame to hold therebetween a front peripheral edge of said skirt and a peripheral edge of said front lens;

said annular main frame having an outer peripheral surface, an inner peripheral surface and a front edge surface formed on said inner peripheral surface to abut against said front peripheral edge of said skirt;

said annular holding frame having an outer edge partially covering the outer peripheral surface of said annular main frame and an inner edge adapted to abut against the peripheral edge of said front lens; and said main frame and said holding frame being integrally interlocked together by first projections and first recesses arranged between the outer peripheral surface of said main frame and the outer edge of said holding frame which covers said outer peripheral surface.

DESCRIPTION OF THE PREFERRED EMBODIMENTS

Details of a diving face mask according to the present invention will be more fully understood from the description given hereunder with reference to the accompanying drawings.

Figure 1:
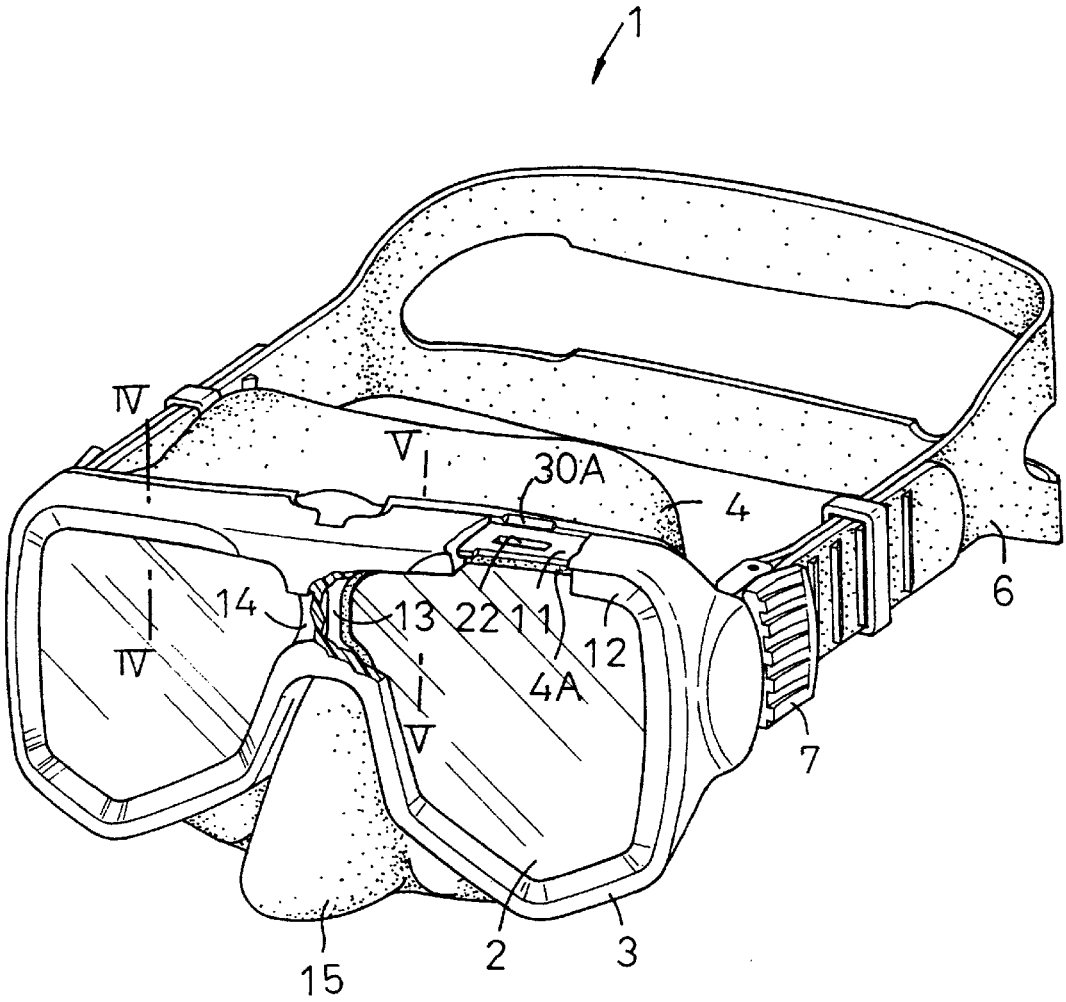
FIG. 1 is a perspective view showing a diving face mask according to the embodiment of the invention as partially broken away.

A diving face mask 1 shown by FIG. 1 in a perspective view as partially broken away comprises a pair of lenses 2, a lens frame 3 in which the lenses 2 are set, a skirt 4 extending rearward from the lens frame 3, and a strap 6 adjustably connected by buckles 7 to the lens frame 3. The lens frame 3 comprises, in turn, an annular main frame 11 and an annular lens holding frame 12 adapted to be detachably set around the main frame 11. These frames 11, 12 are divided symmetrically in right and left halves by first middle and second partitions 13, 14, respectively, each vertically extending between the pair of lenses 2. The skirt 4 is substantially cylindrical and has a pair of front peripheral walls 4A adapted to be placed against later described respective annular portions 19 formed by dividing the main frame 11 in two and a forwardly projecting nose-covering portion 15 exposed below the middle of the lens frame 3.

Figure 2:
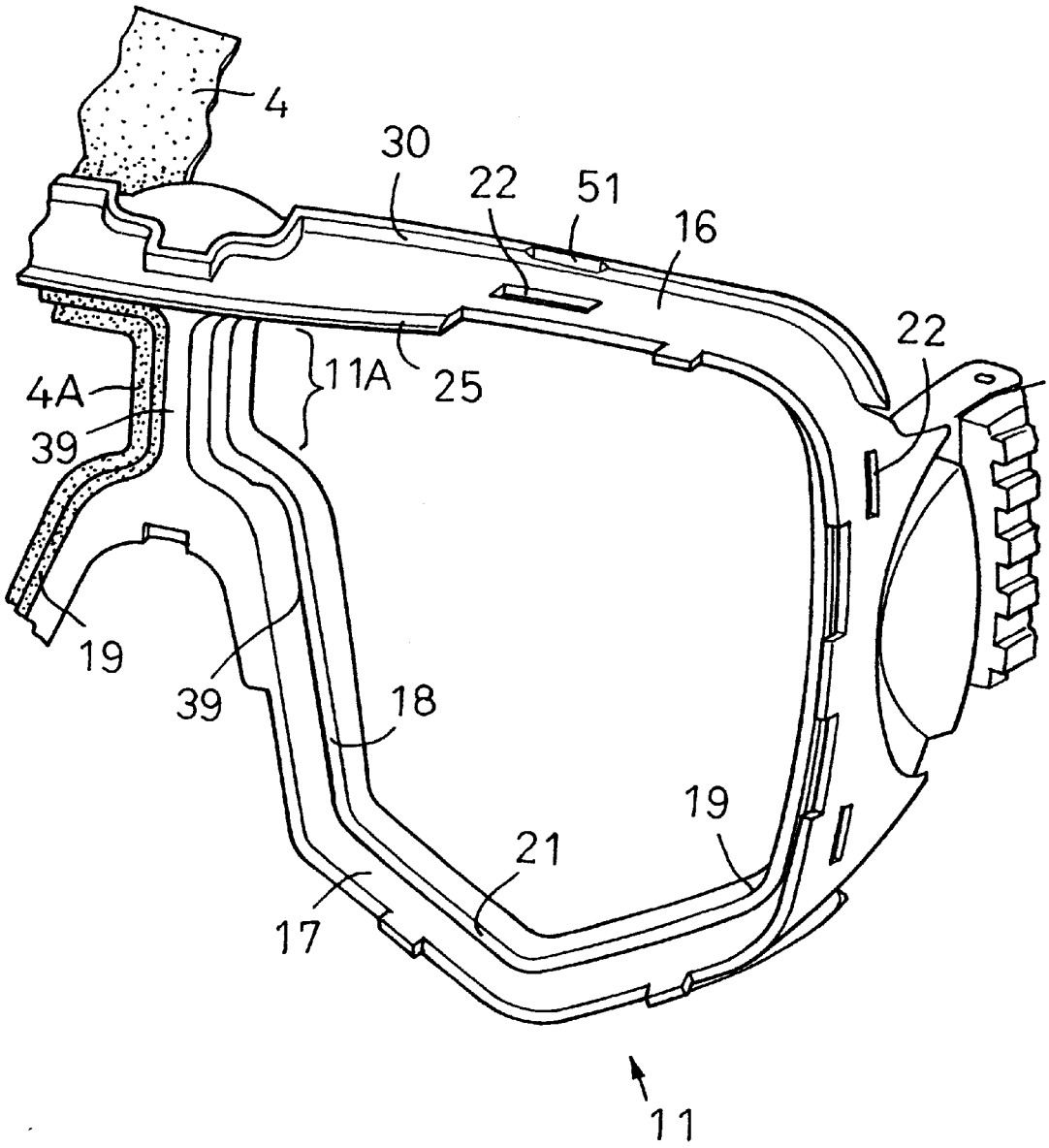
FIG. 2 is a fragmentary plan view of a main frame.

FIG. 2 is a fragmentary perspective view of the main frame 11, in which neither the lens holding frame 12 nor the lenses 2 in FIG. 1 are shown. For the purpose of better understanding, one of the annular portions 19 is shown with the front peripheral wall 4A of the skirt 4 engaged therewith but the other annular portion 19 is shown without the front peripheral wall 4A. The main frame 11 comprises an outer peripheral surface 16, an inner peripheral surface 17 extending in parallel to the outer peripheral surface 16, and a first flange 18 extending along the inner peripheral surface 17 and projecting radially of the annular portion 19 from the inner peripheral surface 17. The first middle partition 13 extends between upper and lower portions of the same inner peripheral surface 17 and a pair of the first annular portions 19 are defined on both sides of the first middle partition 13. The front peripheral wall 4A of the skirt 4 is placed against a front surface of the first flange 18 as well as against a front surface of the first middle partition 13. The main frame 11 includes a middle upper region 25 having a thickness defined between the outer and inner peripheral surfaces 16, 17 and extending forward. The outer peripheral surface 16 is intermittently formed with latch-lock recesses 22 arranged circumferentially of the outer peripheral surface 16. The outer peripheral surface 16 is formed, in addition, along its rear edge with a second flange 30 and a portion of the second flange 30 lying behind one of the latch-lock recesses 22 is formed with a first chamfer 51 by partially cutting away the second flange 30 so that a suitable tool may be received by the first chamfer 51 (See FIG. 4 also). The main frame 11 is formed between the inner peripheral surface 17 and the first flange 18 with a groove 39 except a portion 11A adjacent the first middle portion 13 (See FIG. 4).

Figure 3:
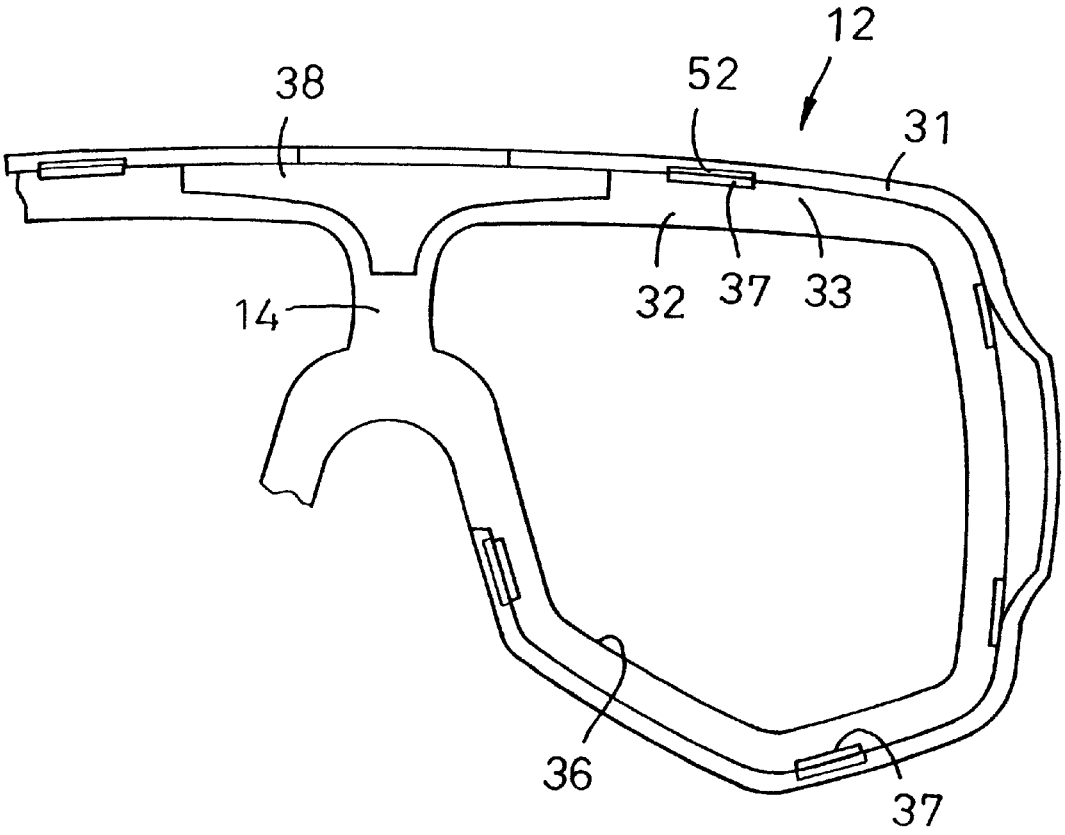
FIG. 3 is a fragmentary perspective view of a lens holding frame.

FIG. 3 is a fragmentary plan view showing an inner side of the lens holding frame 12. This frame 12 comprises an outer peripheral edge 31, an inner peripheral edge 32, and an inner peripheral surface 33 extending between these two peripheral edges 31, 32. The second partition 14 extends between upper and lower portion of the same inner peripheral surface 33 to divide the annular lens holding frame 12 in two and a pair of second annular portions 36 are defined on both sides of the second middle partition 34. In each of these annular portions 36, the outer peripheral edge 31 is intermittently formed on its inner surface with snap-lock projections 37 arranged circumferentially. The inner peripheral surface 33 is formed in an upper middle of the frame 12 with a recess 38. The outer peripheral edge 31 is formed behind the projection 37 with a second chamfer 52 adapted also to receive a suitable tool (See FIG. 4 also).

Figure 4:
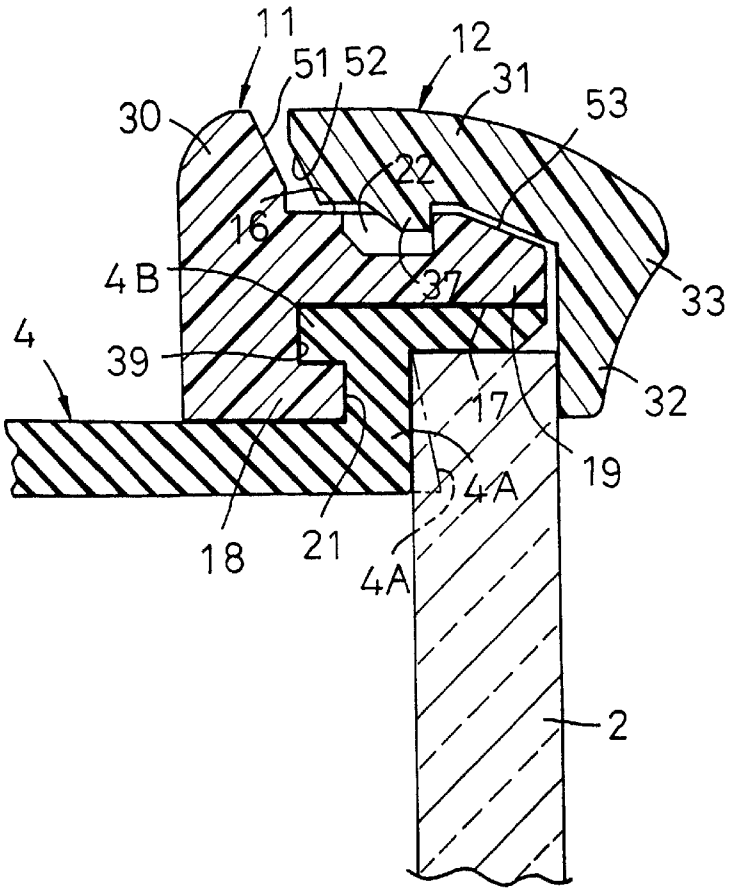
FIG. 4 is a sectional view taken along line IV—IV in FIG. 1.

FIG. 4 is a fragmentary sectional view of the mask 1 taken along line IV—IV in FIG. 1. In the first annular portion 19 of the main frame 11, the front peripheral wall 4A of the skirt 4 abuts against the front surface 21 of the first flange 18 while a rear edge of an outer peripheral wall 4B of the skirt 4 is mated with the groove 39, and the lens 2 abuts against the front peripheral wall 4A while a front edge of the outer peripheral wall 4B is put between the inner peripheral surface 17 and a peripheral edge of the lens 2, as the lens 2 is received by the first annular portion 19 from the front. Once abutted against the first annular portion 19, the front peripheral wall 4A can be no more deformed inwardly of the first annular portion 19. Then the lens holding frame 12 is set around the main frame 11 from its front so that the outer peripheral surface 16 of the main frame 11 may be at least partially covered with the outer peripheral edge portion 31 and the projections 37 formed on a bottom surface of the lens holding frame 12 may be disengageably snap-locked in the recesses 22 of said main frame 11. As the projections 37 are snap-locked in the recesses 22, the inner peripheral edge 32 of the lens holding frame 12 is pressed against a front surface of the lens 2 and thereby the lens and the front peripheral wall 4A of the skirt are water-tightly held by the frame 3. An imaginary line in FIG. 4 represents one of preferred sectional shapes which may be presented by the front peripheral wall 4A before the lens 2 is placed thereagainst. The front surface of the front peripheral wall 4A to be placed against a rear surface of the lens 2 preferably has an annular bulge or projection extending in parallel to the peripheral edge of the lens 2 and adapted to come in substantially linear contact with the rear surface of the lens 2 rather than presenting a planar surface extending in parallel to the rear surface of the lens 21. The front peripheral wall 4A of such configuration will be tightly placed against the rear surface of the lens 2 along the annular bulge or projection and thereby facilitate a water-tight engagement to be ensured between the lens 2 and the front peripheral wall 4A.

Figure 5:
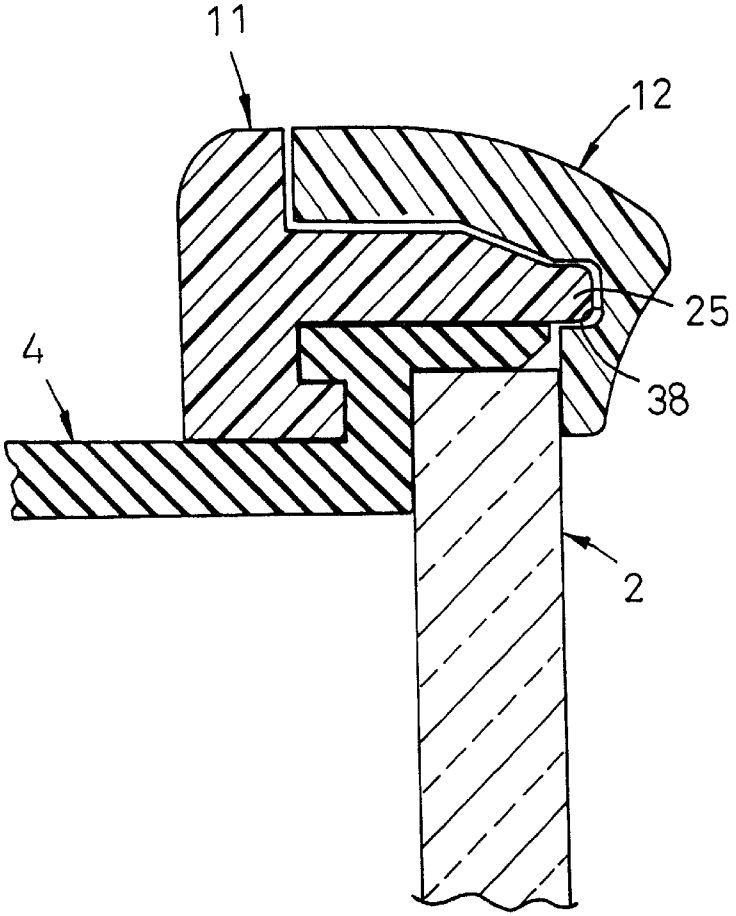
FIG. 5 is a sectional view taken along line V—V in FIG. 5.

FIG. 5 is a fragmentary sectional view of the mask 1 taken along line V—V in FIG. 1. The upper middle portion 25 of the main frame 11 projecting forward is shown in FIG. 5 to be received by the recess 38 formed on the lens holding frame 12. The main frame 11 and lens holding frame 12 are reliably prevented thereby from shifting in vertical and horizontal directions as well as right and left directions.

To exploit the invention, both the main frame 11 and the lens holding frame 12 may be obtained by injection-molding a suitable thermoplastic material. In order that these two frames 11, 12 can be easily interlocked with each other, it is preferable that the main frame 11 is sufficiently rigid to be substantially free from deformation while the lens holding frame 12 can be unrolled under its elastic deformation to be set around the main frame 11. Even when the annular lens holding frame 12 is more or less robust, the annular lens holding frame 12 may be set around the main frame 11 merely by deforming it so as to enlarge its diameter. In this way, operation of setting the annular lens holding frame 12 around the main frame 11 is facilitated in comparison to the conventional case in which the annular lens holding frame must be deformed not so as to enlarge but so as to reduce its diameter sufficiently to fit right with the inner side of the outer frame. Operation of setting the lens holder frame 12 around the main frame 11 is further facilitated particularly when the outer peripheral surface 16 of the main frame 11 is formed in proximity of its front region with a third chamfer 53 sloping down towards the front end, as will be seen in FIG. 4, so that the lens holding frame 12 may be set around the main frame 11 by slidably moving the projections 37 along the third camfer 53 until the projections 37 are snap-locked in the respective recesses 22. Referring to FIG. 4, the lens holding frame 12 can be easily unlocked from the main frame 11 by inserting a flat blade screw driver into a gap between the first and second chamfers.

While the present invention has been described hereinabove with respect to the case the invention is exploited as the diving face mask of paired lens type, the present invention is applicable to the diving face mask of single lens type. An alternative arrangement is also possible that the main frame 11 is formed with the snap-lock recesses 37 and the holding frame 12 is formed with the projections 22. Furthermore, the forwardly directed projection 25 formed on the main frame 11 may be replaced by the rearwardly directed projection formed on the holding frame 12 and the forwardly direction recess 38 formed on the holding frame 12 may be replaced by the rearwardly directed recess formed on the main frame 11.

The diving face mask according to the invention facilitates operation of setting the annular lens holding frame around the main frame since the lens holding frame can At be unrolled under its elastic deformation conveniently to set it around the main frame from the outside.

What is claimed is:

1. A diving mask which comprises:

a lens;

a lens frame assembly in which said lens is mounted;

a cylindrical skirt extending rearwardly from said lens frame assembly;

said lens frame assembly including an annular main frame and an annular holding frame adapted to be detachably locked on said main frame to hold therebetween a front peripheral edge of said skirt and a peripheral edge of said lens;

said annular main frame having an outer peripheral surface, an inner peripheral surface and a front edge surface formed on said inner peripheral surface for abutting against said front peripheral edge of said skirt;

said annular holding frame having an outer edge covering the outer peripheral surface of said annular main frame and an inner edge for abutting against the peripheral edge of said lens; and said main frame and said holding frame being integrally interlockable together by first projections and first recesses arranged between the outer peripheral surface of said main frame and the outer edge of said holding frame which covers said outer peripheral surface.

2. A diving mask according to claim 1, wherein said annular main frame is formed between outer and inner peripheral edges of said main frame with second projections and said holding frame is formed between said outer and inner edges with second recesses, said second projections and said second recesses being detachably interlockable together.

3. A diving mask according to claim 1, wherein the front peripheral edge of said skirt is formed with an annular bulge enabling said front peripheral edge to be substantially in linear contact with the rear surface of said lens.

4. A diving mask according to claim 1, wherein said annular main frame is formed between outer and inner peripheral edges of said main frame with second recesses and said holding frame is formed between said outer and inner edges with second projections, said second projections and said second recesses being detachably interlockable together.

5. A diving mask which comprises:

a lens;

a lens frame assembly in which the lens is mounted;

the lens frame assembly including a main frame and an holding frame adapted to be detachably locked on the main frame to hold therebetween a front peripheral edge of a skirt and a peripheral edge of the lens; and a skirt having a front peripheral edge, the front peripheral edge of the skirt being held between the main frame and the holding frame so that the skirt extends rearwardly from the lens frame assembly;

the main frame having an outer peripheral surface, an inner peripheral surface and a front edge surface formed on the inner peripheral surface for abutting against the front peripheral edge of the skirt;

the holding frame having an outer edge covering the outer peripheral surface of the main frame and an inner edge for abutting against the peripheral edge of the lens; and the main frame and the holding frame being integrally interlockable together by first projections and first recesses arranged between the outer peripheral surface of the main frame and the outer edge of the holding frame which covers the outer peripheral surface.

6. A diving mask according to claim 5, wherein the main frame is formed between outer and inner peripheral edges of the main frame with second projections and the holding frame is formed between the outer and inner edges with second recesses, the second projections and the second recesses being detachably interlockable together.

7. A diving mask according to claim 5, wherein the front peripheral edge of the skirt is formed with an bulge enabling the front peripheral edge to be substantially in linear contact with the rear surface of the lens.

8. A diving mask according to claim 5, wherein the main frame is formed between outer and inner peripheral edges of the main frame with second recesses and the holding frame is formed between the outer and inner edges with second projections, the second projections and the second recesses being detachably interlockable together.

* * * * *